United States Patent [19]

Purro

[11] 4,455,369

[45] Jun. 19, 1984

[54] METHOD OF CREATING IMAGE ON LIGHT SENSITIVE SHEET

[76] Inventor: Norina M. Purro, 422 First Ave., East Greenwich, R.I. 02818

[21] Appl. No.: 435,150

[22] Filed: Oct. 19, 1982

[51] Int. Cl.[3] ..... G03C 7/00

[52] U.S. Cl. ..... 430/357; 430/365; 430/396; 355/1

[58] Field of Search ..... 355/1, 32, 88; 430/357, 430/365, 396, 5, 952; 354/4

[56] References Cited

U.S. PATENT DOCUMENTS

| | | | |
|---|---|---|---|
| 3,149,969 | 9/1964 | Vlahos | 430/396 |
| 3,184,307 | 5/1965 | Letzer | 430/396 |
| 3,265,503 | 8/1966 | Bodmer et al. | 430/365 |
| 3,320,617 | 5/1967 | Hawkins et al. | 430/396 |
| 3,324,764 | 6/1967 | Altman | 430/952 |
| 3,737,224 | 6/1973 | Culler | 355/32 |
| 3,825,335 | 7/1974 | Reynolds | 355/1 |
| 4,003,061 | 1/1977 | LaCanfora | 354/4 |
| 4,188,111 | 2/1980 | Marvin | 355/1 |
| 4,249,807 | 2/1981 | Webster et al. | 354/4 |
| 4,249,808 | 2/1981 | Webster | 354/4 |

*Primary Examiner*—J. Travis Brown

*Attorney, Agent, or Firm*—Salter & Michaelson

[57] ABSTRACT

A method of creating designs and images on a color photographic sheet. The sheet is selectively exposed by passing light beams of preselected colors, i.e. preselected wave length ranges over selected areas thereof under darkroom conditions. Thereafter the sheet is processed by conventional photographic techniques to develop the images.

7 Claims, 4 Drawing Figures

METHOD OF CREATING IMAGE ON LIGHT SENSITIVE SHEET

BACKGROUND AND SUMMARY OF THE INVENTION

The instant invention relates to a novel method of creating artistic designs and images, on light sensative color photographic sheets.

A wide variety of techniques for recording artistic expression have heretofore been available, including free hand painting and sketching, as well as various forms of photographic art. The method of the instant invention provides a novel medium for artistic expression wherein free hand sketching or "painting" on a color photographic sheet is achieved by utilizing a narrow or intensified light beam. Specifically, it has been found that by selectively exposing a previously unexposed color photographic sheet to light rays of preselected colors and intensities under darkroom conditions and thereafter developing the sheet by conventional photographic processing techniques, unusual and aesthically rewarding designs and images can be created thereon. In this regard, it has been found that by passing a light pencil or light probe over selected areas of a previously unexposed color photographic sheet to effect selective exposure thereof, it is possible to "paint" or "sketch" with the light beam to create desired designs and/or images on the sheet. Further, it has been found that by selectively filtering the light beam emitted from the pencil or probe, it is possible to selectively expose the sheet to light rays of preselected colors or wave length ranges whereby designs and/or images of brilliant colors can be produced on the sheet. The use of masks or stencils to facilitate the the desired exposure of preselected areas of the sheet has been found to further enhance the method. However, the use of other conventional techniques to provide the desired selective exposure of the sheet to light in the method of the instant invention is also contemplated.

The closest prior art to the instant invention of which the applicant is aware is a technique known as the "photogram" method, wherein an object is positioned on a light sensitive sheet and thereafter the sheet is exposed to a light source whereby a shadow or silohuette of the object is produced on the sheet. The "photogram" method has been utilized primarily on black and white photographic sheets utilizing unrestricted or broad general light sources of random wave lengths. In contrast, the method of the instant invention relies on selective exposure of a color photographic sheet to light rays of preselected intensities and preselected colors, i.e. preselected wave length ranges. Further, in the preferred method, selective exposure of the sheet is effected utilizing a restricted or narrow pencil beam of light whereby an artist may "paint" or "sketch" on the sheet with the beam.

The only other prior art of which the applicant is aware which pertains generally to the subject matter of the instant invention is disclosed in the U.S. Pat. No. 3,686,675 to FAUL et al,; REYNOLDS, U.S. Pat. No. 3,825,335; and MARVIN, U.S. Pat. No. 4,188,111. These patents, however, are felt to be of nothing more than general interest and cannot be considered as anticipatory of the selective photographic exposure techniques embodied in the instant invention.

Accordingly, it is a primary object of the instant invention to provide a method of "painting" with colored light beams.

Another object of the instant invention is to provide a novel medium for artistic expression.

A still further object of the instant invention is to provide a method of selectively exposing a color photographic sheet.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
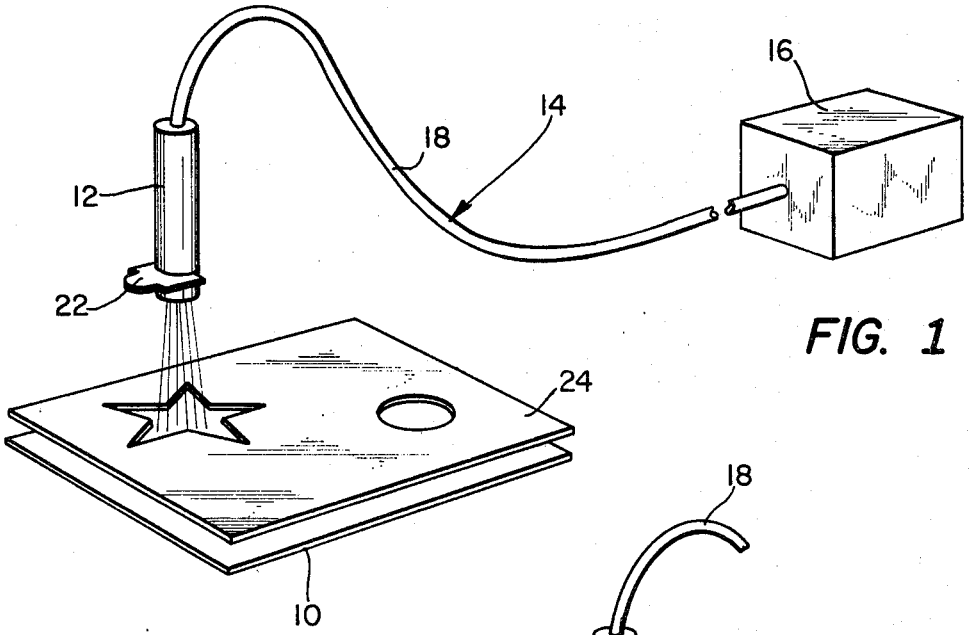
FIG. 1 is a perspective view of the selective exposure of a color photographic sheet to a light beam of a first preselected color.
Figure 2:
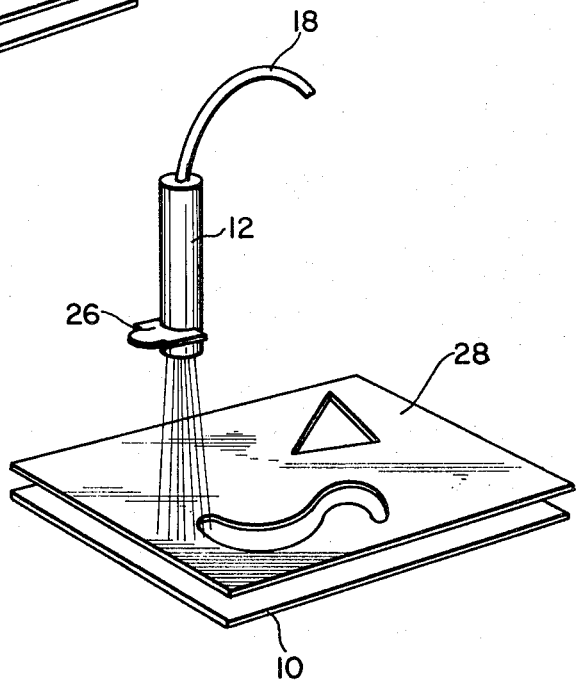
FIG. 2 is a perspective view of the further selective exposure of the sheet to a light beam of a second preselected color.

Referring now to the drawing, particularly FIGS. 1 and 2, the method of the instant invention is illustrated. The method is effected under darkroom conditions by selectively exposing a colored light sensitive sheet 10 to light rays of preselected colors, i.e. preselected wave length ranges. Specifically, the selective exposure of the sheet 10 is effected utilizing a narrow light beam emitted from a light pencil or probe 12 which comprises part of an illuminating assembly 14. Thereafter, the sheet 10 is processed by conventional photographic techniques to develop and preserve the exposed images created thereon by the light rays.

The sheet 10 comprises a conventional color photographic sheet which may be either a positive or negative color photographic paper or film. It has been found, however that due to the color losses caused by diffusion which inherently takes place during image transfer steps in photographic processing, the use of positive photographic paper for the sheet 10 is preferable since positive photographic paper does not require image transfer steps in the developing thereof. In this connection, Cibachrome-A (Ilford TM) photographic paper has been found to be particularly effective for achieving optimal results with vivid images of high color brilliance although the use of other positive papers is contemplated.

The illuminating assembly 14 comprises a conventional fiber optic illuminator which includes a light generator portion 16, a fiber optic transmission cable 18, and the probe 12. A halogen bulb, such as a quartz iodide bulb, is utilized in the generator portion 16 to provide a clear white source of light, the light being transmitted through the cable 18 to the probe 12. Preferably the assembly 14 also includes means for varying the intensity of the light emitted by the probe 12 whereby the exposure of the sheet 10 to the desired degree can be affected. The probe 12 comprises a tubular member which is adapted to produce an intensified or narrow light beam as the light is received from the cable 18 whereby the light can be directed on selected areas of the sheet 10 by passing the light probe 12 thereover. A transverse slot 20 is provided adjacent the outer end of the probe 12 for receiving a filter 22 whereby light rays of only a preselected color or wave length range are emitted from the probe 12. The filter 22 preferably comprises a gelatin filter of the type marketed by the Kodak Company as a "Ratten" gelatin filter, or the like, and is interchangeable with other filters of similar configurations and types to provide light rays of preselected wave length ranges or colors ranges as desired. It will be understood, however, that use of other types of illuminators, probes and filters to effect the desired selective exposure of the sheet 10 is contemplated. For example, a computerized system could be employed in association with the probe whereby filter selection and/or combinations of filters to effect desired colors, hues and shades could be obtained by computer.

In application, the method of the instant invention is carried out by energizing the illuminating assembly 14 and thereafter passing the probe 12 over selected areas of the sheet 10 to effect the desired selective exposure thereof to light rays of a preselected color or wave length range as defined by the filter 22. It should be brought out in this regard that the exposure of the sheet 10 must be effected under strict darkroom conditions and that extraneous light from any source should be avoided to prevent inadvertent exposure of the sheet 10. As illustrated in FIG. 1, a stencil 24 may be utilized to mask certain areas of the sheet 10 to achieve the desired selective exposure thereof. Thereafter, as illustrated in FIG. 2, the selective exposure of the sheet 10 to light rays of a different color or wave length range is effected using a second preselected filter 26 and a second stencil 28. After the sheet 10 has been exposed as desired, the developing thereof is carried out by conventional photographic developing processes to bring out and preserve the images created thereon.

Figure 3:
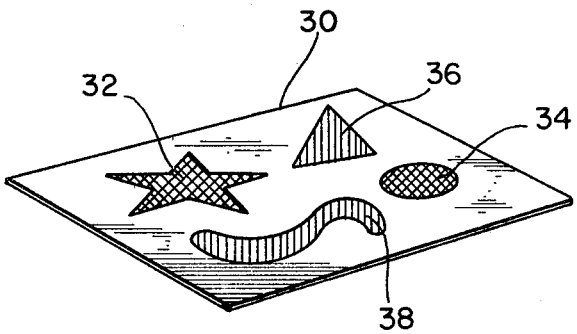
FIG. 3 is a perspective view of the sheet subsequent to the developing thereof.
Figure 4:
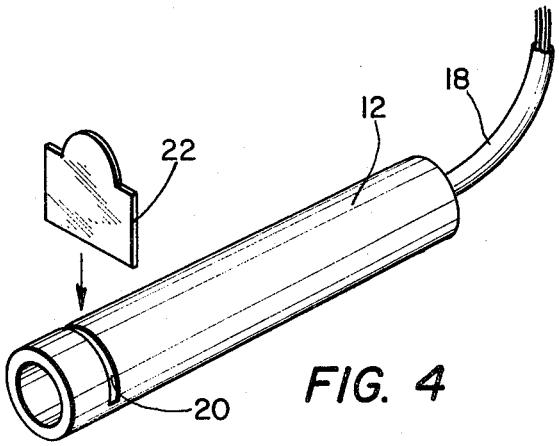
FIG. 4 is a perspective view of a light probe and filter as utilized in the method of the instant invention.

The fully developed sheet 30 illustrated in FIG. 3 is illustrative of the results which are achieved by the above described selective exposure techniques. In this regard the sheet 30 has images 32 and 34 thereon which results from the use of the filter 22 and the stencil 24, and images 36 and 38 which result from the use of the filter 26 and the stencil 28. It will be understood, however, that while the method as herein described which utilizes conventional masking techniques is generally illustrative of the method of the instant invention, the use of other artistic methods, the effectiveness of which may depend on the talents of each particular artist, to effect the selective exposure of the sheet 10 with the illuminator 14 is contemplated. Specifically, the artist can "paint" with colored light in a free form style, i.e., without using any stencils or masks.

It is seen therefore that the method of the instant invention provides a novel medium for artistic expression which utilizes light rays to create desired designs and/or images in desired colors. The method of the instant invention has wide applicability in both commercial and noncommercial art and provides a novel means of producing images of vivid colors which have heretofore been difficult to produce. For these reasons, the method of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of painting with light on a color photographic sheet comprising:

a. manually passing a movable light probe, of the type which emits a narrow light beam of a preselected color and intensity, over selected areas of said sheet using freehand strokes under darkroom conditions to selectively expose said areas to said light beam in an artistic manner and thereby provide an artistic expression on said sheet; and b. developing said sheet.

2. In the method of claim 1, said probe being selectively operative for emitting light beams of different preselected colors and intensities, said method further comprising passing said probe over said sheet to expose said sheet to a plurality of light beams of different preselected colors and intensities.

3. In the method of claim 1, said sheet further characterized as a positive photographic sheet.

4. The method of claim 1, wherein said probe comprises a filtered fiber optic light probe.

5. In the method of claim 1, said step of selectively exposing said sheet comprising:

a. overlaying a stencil on said sheet to mask selected areas thereof;

b. exposing said sheet with said stencil thereon to light rays of a preselected color and intensity under darkroom conditions.

6. In the method of claim 1, said light rays being filtered to provide said preselected color.

7. In the method of claim 4, said fiber optic probe further characterized as having a halogen bulb light source and a filter to provide said light rays.

* * * * *